United States Patent [19]

Crocker et al.

[11] Patent Number: 5,036,949

[45] Date of Patent: Aug. 6, 1991

[54] MOTION-STOPPING SAFETY SYSTEM FOR WORKERS

[75] Inventors: Clarence L. Crocker, West Columbia; Ward Woodard, Jr., Brazoria; Howard C. Hewett, Jr., Freeport, all of Tex.

[73] Assignee: The Dow Chemical Company, Midland, Mich.

[21] Appl. No.: 515,375

[22] Filed: Apr. 27, 1990

[51] Int. Cl.[5] ..... A62B 35/00

[52] U.S. Cl. ..... 182/3; 248/237; 248/231.7; 269/249

[58] Field of Search ..... 182/3, 5, 45; 248/237, 248/231.7, 228, 229, 128; 269/249

[56] References Cited

U.S. PATENT DOCUMENTS

| | | | |
|---|---|---|---|
| 676,303 | 6/1901 | Cramer | 269/249 |
| 1,224,405 | 5/1917 | Nienstadt | 248/231.7 |
| 2,693,386 | 11/1954 | Renfroe | 269/249 |
| 3,137,487 | 6/1964 | Lesser . | |
| 3,237,717 | 3/1966 | Jackson . | |
| 3,934,316 | 1/1976 | Driscoll | 269/249 |
| 4,249,713 | 2/1981 | Glynn et al. . | |
| 4,541,155 | 9/1985 | Gagnon | 24/514 |
| 4,674,596 | 6/1987 | Weiner | 182/3 |
| 4,699,245 | 10/1990 | Benedet . | |
| 4,823,636 | 4/1989 | Suska | 24/514 |

OTHER PUBLICATIONS

"Fall Protection Tips," Research & Trading Corporation, 1984.

"Subpart M—Floor and Wall Openings, and Stairways", Title 29, Chapter XVII—OSHA, Section 1926.500.

"Fall Protection and Emergency Descent Systems," Research & Trading Corporation.

*Primary Examiner*—Reinaldo P. Machado

[57] ABSTRACT

A motion-stopping safety system for persons, workers, and in one embodiment for roof workers. A gripping anchor for gripping a structural member useful in such systems. In one embodiment a gripping anchor has a C-shaped body member with facing members secured thereto and a line connection device, e.g. an opening or a clevis, shackle, or metal loop, connected to the body member. In one embodiment a motion-stopping safety system uses two or more such anchors between which extend a rope, line, cable, etc., and to which a person's safety tether is movably or immovably attached.

9 Claims, 3 Drawing Sheets

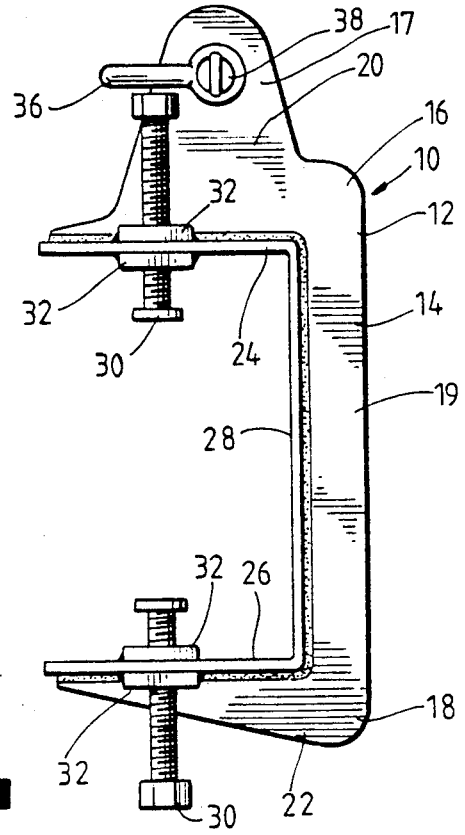
FIG.1
FIG.2
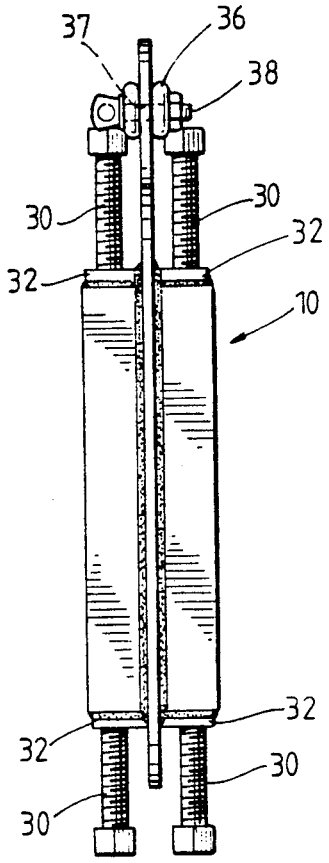
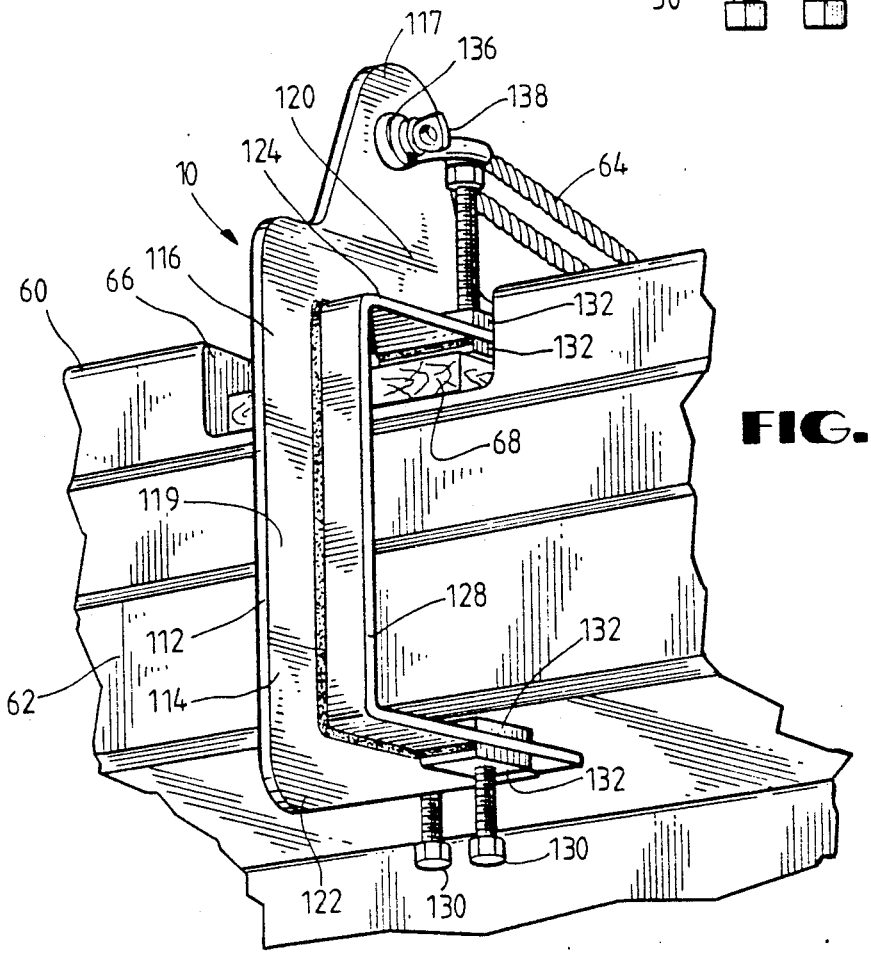
FIG.3

MOTION-STOPPING SAFETY SYSTEM FOR WORKERS

BACKGROUND OF THE INVENTION

1. Field of the Invention

This invention is directed to a motion-stopping safety system for workers, in one aspect for roof workers, and to gripping anchors which, in one aspect, are usable as roof-gripping anchors.

2. Description of Related Art

Often it is dangerous to work on a roof or elevated structure. The U.S. Occupational Safety and Health Administration regulations requires that a motion-stopping safety system or an alternative be used by workers working on certain roofs with a ground to eave height greater than 16 feed (4.9 meters). Such workers are to be protected from falling from all unprotected sides and edges of a roof. Employers are required to train employees to recognize and deal with the hazards of falling associated with working near a roof perimeter.

The prior art discloses a variety of attempts to make the roof working environment safer. U.S. Pat. No. 3,237,717 discloses a roof rigging system to which a roofer is anchored. The system employs a plurality of brackets disposed on a roof interconnected by flexbile cables and tubular rods. Anchor lines are connected between these apparatus and the roofer.

U.S. Pat. No. 4,249,713 disclosed an attachment member for roof peaks to which a roofer attaches a safety line. The attachment member is a strip of metal, bent double, with a hole in it for receiving and holding a hook attached to the safety line. Nail holes in the metal strips allow the attachment member to be nailed to a part of a roof.

U.S. Pat. No. 5,699,245 discloses a roof safety cable system with a plurality of cable supports and cable holding plates. A tether extends between a worker on a roof and the cables.

U.S. Pat. No. 3,137,487 discloses a safety belt for scaffolds and a C-clamp shown as attached to a flange of an I-beam. An arm extending from the C-clamp abuts the I-beam and has a rope or cable connected to it which extends to a worker's safety belt.

Research and Trading Corporation's booklet, "Fall Protection and Emergency Descent Systems," discloses a variety of line, webbing, lanyard and cable systems which are connectible to a variety of cables and supports for worker safety.

There has long been a need for an efficient and effective motion stopping safety system. There has long been a need for such a system which can be easily manipulated, emplaced, removed, and re-emplaced as workers finish in one area and move on to another. There has long been a need for a relatively simple roof safety system which will stop a worker's motion when she or he nears the edge of the roof. There has long been a need for a gripping anchor useful in such systems which is easily manipulable, strong, and can accommodate a variety of roof edge configurations.

SUMMARY OF THE PRESENT INVENTION

The present invention discloses a motion-stopping safety system for workers and gripping anchors for such a system. In one embodiment a motion-stopping safety system according to the present invention is for use on roofs by roof workers and includes a plurality of roof gripping anchors with a rope, line, or cable tied to and between the gripping anchors. A safety rope, cable or lanyard is fixed to the line between the gripping anchors and, in one embodiment, is immovably fixed so that a worker's range of motion is limited. In one embodiment a griping anchor according to the present invention has a C-shaped body member with a line connection device (e.g. clevis or shackle) to which a cable, etc. can be easily secured. Bolts extending through the top of the body member and through its bottom can be tightened to secure the body member to the edge of a roof or platform. By placing two or more gripping anchors at different points on a roof edge and typing a line between them, the outer limits of motion for a worker connected to the line are defined. A worker's safety tether can be movably connected to this line. By immovably securing a worker's tether to this line, the worker's range of motion is further restricted. By suitably securing the tether, the worker's motion can be stopped short of the roof edge in one or several directions. By using a single gripping anchor according to the present invention and a tether of appropriate length, a worker's fall can be arrested prior to impact on the ground.

It is, therefore, an object of the present invention to provide a new, useful, efficient, unique and nonobvious motion-stopping safety system and a gripping anchor for such a system.

Another object of the present invention is the provision of a motion-stopping safety system for roof workers.

Yet another object of the present invention is the provision of such a system which can be easily installed in an initial position for limiting a worker's initial range of motion and which can then be quickly and safely re-deployed to provide a worker safe access to another area.

A further object of the present invention is the provision of a motion-stopping safety system which satisfies the requirements of the United States Occupational Safety and Health Administration for an MSS System 29 C.F.R., Subpart M, §1926.500.

An additional object of the present invention is the provision of a motion-stopping safety system which is strong enough to withstand forces applied by a workers and which, if necessary, can support the worker and arrest a worker's fall.

Another object of the present invention is the provision of a gripping anchor for use in such systems.

Yet another object of the present invention is the provision of a gripping anchor which is emplaceable about the edge of a roof, platform, or structure.

A further object of the present invention is the provision of a gripping anchor to which a cable, line or rope can be easily connected or from which they can be quickly disconnected.

An additional object of the present invention is the provision of a gripping anchor with opposed tightening devices on different portions of the gripping anchor for securely attaching it to another member.

The present invention recognizes and addresses the previously-mentioned long-felt needs and provides a satisfactory meeting of those needs in its various possible embodiments. To one of skill in this art who has the benefits of this invention's teachings and disclosures, further objects and advantages will be clear, as well as other inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is claim an invention no matter how others may later disguise it by variations in form or additions or further improvements.

DESCRIPTION OF THE DRAWINGS

So that the manner in which the above-recited features, advantages and objects of the invention, as well as other which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

FIG. 1 is a side view of a gripping anchor according to the present invention.

FIG. 2 is an end view of the anchor of FIG. 1.

FIG. 3 is a perspective view of a portion of a motion-stopping safety system according to the present invention.

Referring now to FIGS. 1 and 2 a gripping anchor 10 according to the present invention has a body member 12 which has an upright member 14, a top arm 20, and a bottom arm 22. The upright member 14 has a top 16, a bottom 18, and a mid-portion 19.

Figure 4:
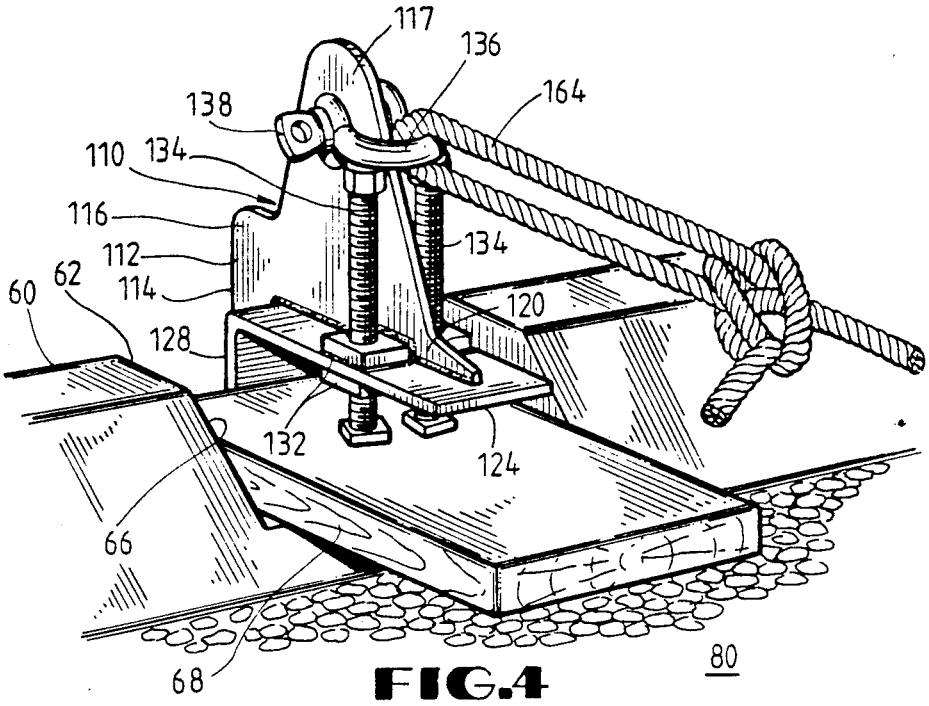
FIG. 4 is a top perspective view of the system of FIG. 3.

An upstanding shoulder 17 extends from the top arm 20 and a top facing member 24 is formed of or secured to the top arm 20, e.g. by welding if the gripping anchor is made from metal or by gluing if it is made from material that can be glued. A pin 38 extends through a shackle 36 and a hole 37 in the shoulder 17 to hold the shackle movably in place. The hole 37 is, preferably, disposed in the top of the shoulder 17 but could be located elsewhere in the shoulder 17, to arm 20, body member 12, or facing members 24, 26, 28.

A middle facing member 28 is formed integrally with or secured to the mid-portion 19 of the body member 12 and a bottom facing member 26 is formed integrally with or secured to the bottom arm 22. The facing members 24, 26, and 28 are shown substantially normal to the plane of the portions of the body member 12. However, it is within the scope of this invention for the facing members to be disposed at some desired angle other than 90° to their corresponding portion of the body member 12. The facing members can abut or face up against a surface of a structural member about which the gripping anchor 10 is disposed for enhanced stability and ease of correct emplacement.

Bolts 30 extend through holes 31 in reinforcement plates 32 secured to the top facing member 24 and through holes 25 in the top facing member 24. Bolts 30 also extend through holes 31 in reinforcement plates 32 secured to the bottom facing member 26 and through holes 27 in the bottom facing member 26. The bolts 30 through the top facing member are disposed substantially opposite the bolts 30 through the bottom facing member. The bolts 30 are threadedly and movably engaged in the holes 31 so that they can be tightened or loosened to accommodate the gripping anchor to the particular structural member about which it is to be emplaced and to secure it to that structural member by tightening the bolts. Nuts 33 are tightened to hold the bolts in place. Although four bolts 30 are shown in the embodiment illustrated in FIG. 2, it is within the scope of this invention to use one or more bolts disposed int he facing members 24 or 26. For a permanent or semi-permanent emplacement of a griping anchor according to the present invention, the bolts 30 may be of sufficient length that they can enter holes in the structural member about which the gripping anchor is emplaced; or appropriate screws may be used which enter into the structural member to further secure the gripping anchor to the structural member.

Although a movable shackle 36 is shown in FIGS. 1 and 2, it is within the scope of this invention to simply provide the hole 37 as a device through which a line can be connected to the gripping anchor 10.

As illustrated in FIGS. 3 and 4 a gripping anchor 110 like the gripping anchor 10 is shown secured to an overhang 62 of a roof 60. The gripping anchor 110 has a body member 112 which has an upright member 114 with a top 116, a bottom 118, and a mid-portion 119. A top arm 120 and a bottom arm 122 extend from the upright member 114. A top facing member 124, a middle facing member 128, and a bottom facing member 126 are secured to the body member 112. Bolts 130 extend through reinforcing plates 132 on the bottom facing member 122 and through the bottom arm itself and bolts 134 extend through reinforcing plates 132 on the top arm 120 and through the top arm itself. As shown, the shackle 136 rests on the top of the bolts 134. An upstanding shoulder 117 extending from the top arm 120 has a hole in it through which extends a pin 138 holding a shackle 136 through which a rope 64 passes.

The gripping anchor 110 is partially disposed in an indentation 66 in the roof 62. A block of wood 68 between a bottom 67 of the indentation 66 and the top facing member 124 acts as a space occupier. Parts of the middle facing member 128 abut portions of the roof overhand 62. The bolts 130 have been tightened against the bottom of the overhand 62 and the bolts 134 have been tightened against the wood block 68 so that the gripping anchor 110 is secured about the roof overhand 62. Although the roof 60 has an indentation 66 in which the gripping anchor is disposed, it could have been positioned at another point on the roof overhand and secured in position.

Figure 5:
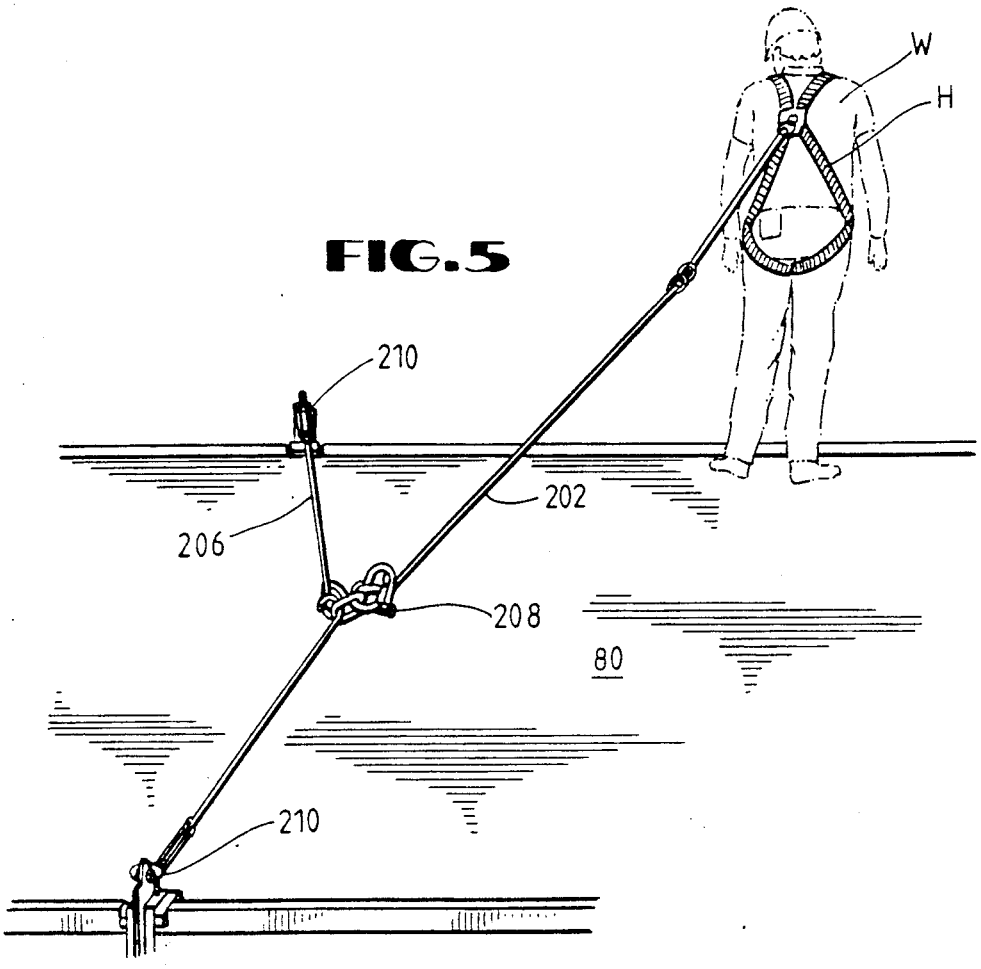
FIG. 5 is a top perspective view of a motion stopping safety system according to the present invention.
Figure 6:
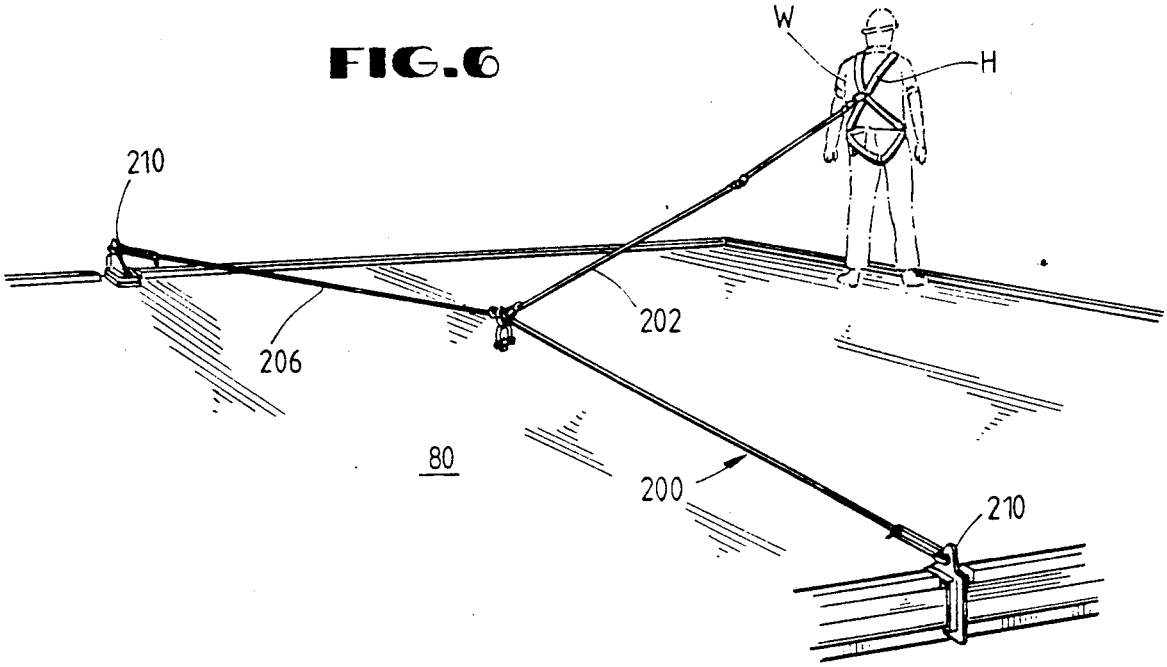
FIG. 6 is a top perspective view of the system of FIG. 5.

FIGS. 5 and 6 illustrate a motion-stopping safety system 200 according to the present invention which employs gripping anchors 210 according to the present invention. The MSS system 200 is employed on a roof 80 to limit or arrest the motion of a worker W.

The MSS system 200 includes: the gripping anchors 210 (like the anchors 110 and 10); a rope 206 tied to and extending between the gripping anchors 210; a safety line (rope) 202 secured to the rope 206 at one end and to a harness H on the worker W at the other end. The safety line 202 is immovably secured to a metal loop 208 to which the rope 206 is tied so that it will not move back and forth on the rope 206, thus limiting the range of motion of the worker W. When the loop 208 is appropriately positioned, the worker W can approach an edge of the roof 80 but cannot step (or fall) beyond it. By untying the rope from the metal loop 208 and retying it at another location on the rope 206, the worker W can safely access another area on the roof. If desired, the metal loop 208 can be movably disposed on the rope 206 (or the loop 208 can be eliminated and the safety line 202 can be movably tied to the rope 206) so that the worker W can move along the entire length of the rope 206. However, such a deployment of the system 200 will not necessarily prevent the worker W from going beyond the roof's edge.

Figure 7:
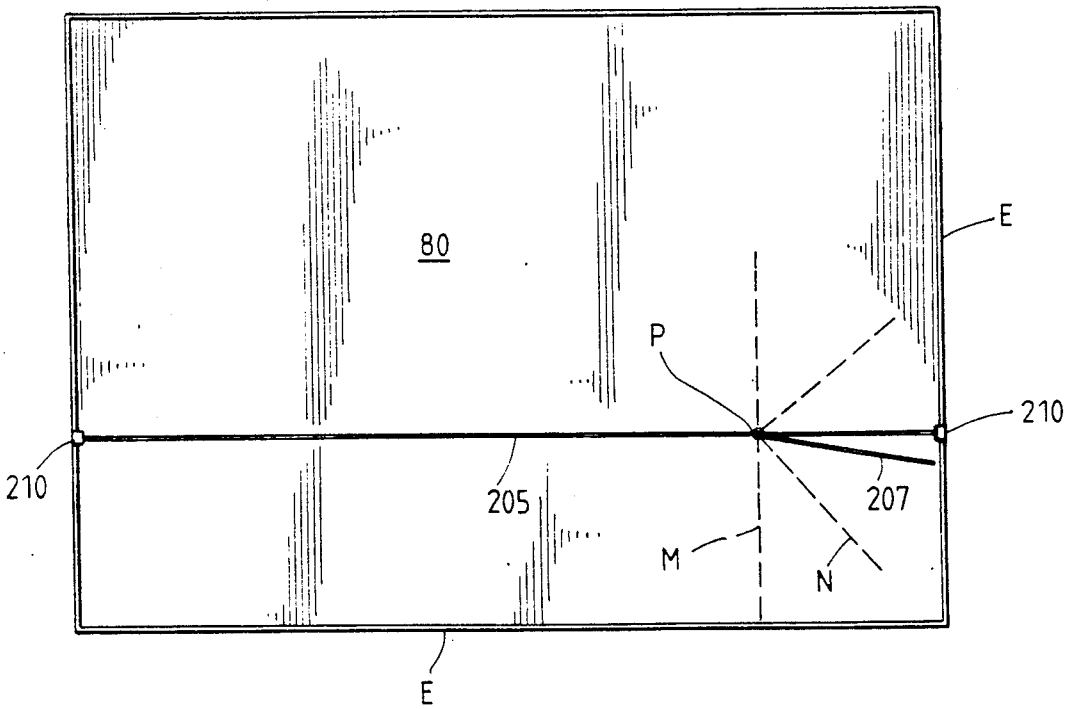
FIG. 7 is a diagram showing schematically the range of motion with a motion-stopping safety system according to the present invention.

FIG. 7 illustrates schematically the disposition of the MSS system 200 on a roof 90. Two gripping anchors 210 are emplaced on a roof overhang at opposite sides of the roof 90. A cable 205 extends between the anchors 210 and an end of the cable 205 is tied to each anchor 210. A safety line 207 (which can be attached to a worker, not shown) is immovably affixed at point P to the cable 205. Dotted lines M, N, and O illustrate the range of motion allowed by the system 200 in this configuration and also illustrate that a worker will be prevented from going beyond the edges E of the roof 80.

In conclusion, therefore, it is seen that the present invention and the embodiments disclosed herein are well adapted to carry out the objectives and obtain the ends set forth at the outset. Certain changes can be made in the method and apparatus without departing from the spirit and scope of this invention. It is realized that changes are possible and it is further intended that each element or step recited in any of the following claims is to be understood as referring to all equivalent elements or steps for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as others inherent therein.

What is claimed is:

1. A motion-stopping safety system for arresting motion of a worker connected to the system for limiting the extent of that motion, and for securement in a work area to a structural member or members in the work area as its perimeter, or extending thereabout, the system comprising two gripping anchors spaced apart and removably secured to the structural member or members, a cable tied between the two gripping anchors;

a worker's line connected to the cable and for connection to a belt or harness secured to the worker, the worker's line of pre-determined length for limiting the extend of the worker's motion, and the gripping anchors each comprising a C-shaped body member having an upright member having a top and a bottom, a top arm member extending outward from the top of the upright member and a bottom arm member extending outward from the bottom of the upright member, a top facing member secured to the top arm, a bottom facing member secured to the bottom arm, adjustable securement means movably disposed through the top facing member and the bottom facing member for securing the gripping anchor to the structural member, and line connection means on the body member for connecting thereto a safety line.

2. The motion-stopping safety system of claim 1 wherein the worker's line is immovably connected to the cable.

3. The motion-stopping safety system of claim 1 wherein the gripping anchors' adjustable securement means is one or more bolts threadedly engaged and extending through one of the facing members.

4. The motion-stopping safety system of claim 1 wherein each facing member of the gripping anchors has one or more bolts therethrough.

5. The motion-stopping safety system of claim 1 wherein each gripping anchor also includes a middle facing member secured to the upright member of the C-shaped body member.

6. The motion-stopping safety system of claim 1 wherein the gripping anchors' line connection means is shackle movably connected to the C-shaped body member.

7. The motion-stopping safety system of claim 1 wherein the top facing members of the gripping anchors are substantially normal to their respective top arms and the bottom facing member are substantially normal to their respective bottom arms.

8. The motion-stopping safety system of claim 2 wherein the middle facing members are substantially normal to their respective upright members of the C-shaped body member.

9. A motion-stopping safety system for arresting motion of a worker connected to the system for limiting the extend of that motion, and for securement in a work area to a structural member or members in the work area at is perimeter, or extending thereabout, the system comprising two gripping anchors spaced apart and removably secured to the structural member or members, a cable tied between the two gripping anchors, a worker's line immovably connected to the cable and for connection to a belt or harness secured to the worker, the worker's line of pre-determined length for limiting the extent of the worker's motion, and the gripping anchors each comprising a C-shaped body member having an upright member having a top and a bottom, a top arm member extending outward from the top of the upright member and a bottom arm member extending outward from the bottom of the upright member, a top facing member secured to the top arm, a middle facing member secured to the upright member of the C-shaped body member, a bottom facing member-secured to the bottom arm, all the facing members disposed substantially normal to the body member, one or more bolts threadedly engaged and extending through one of the facing members movably disposed through the top facing member and the bottom facing member for securing the gripping anchor to the structural member, and a shackle movably connected to the body member for connecting thereto a safety line.

* * * * *